US006154930A

United States Patent [19]

Verzegnassi et al.

[11] Patent Number: 6,154,930

[45] Date of Patent: Dec. 5, 2000

[54] DRAWING FRAME WITH TWO DRAWING HEADS IN CASCADE

[75] Inventors: Angelo Verzegnassi, Manzano; Sergio Benetti, Ronchi dei Legionari, both of Italy

[73] Assignee: Vouk S.p.A. Officine Meccanotessili, Gorizia, Italy

[21] Appl. No.: 09/367,856

[22] PCT Filed: Aug. 4, 1997

[86] PCT No.: PCT/EP97/04228

§ 371 Date: Aug. 31, 1999

§ 102(e) Date: Aug. 31, 1999

[87] PCT Pub. No.: WO98/40546

PCT Pub. Date: Sep. 17, 1998

[30] Foreign Application Priority Data

Mar. 13, 1997 [IT] Italy ..... MI97A0568

[51] Int. Cl.[7] ..... D04H 11/00

[52] U.S. Cl. ..... 19/159 A; 19/157; 19/239

[58] Field of Search ..... 19/0.22, 0.23, 19/65 A, 157, 159 A, 159 R, 236, 237, 239; 57/90, 281, 315

[56] References Cited

U.S. PATENT DOCUMENTS

| | | | |
|---|---|---|---|
| 4,577,372 | 3/1986 | Roder | 19/159 A |
| 5,138,558 | 8/1992 | Meyer et al. | 19/159 A |
| 5,271,214 | 12/1993 | Stahlecker et al. | 57/315 |
| 5,287,693 | 2/1994 | Stahlecker | 57/90 |
| 5,465,565 | 11/1995 | Tsuzuki | 57/90 |
| 5,481,859 | 1/1996 | Mann et al. | 57/90 |
| 5,687,454 | 11/1997 | Langen | 19/159 A |

*Primary Examiner*—Michael A. Neas
*Assistant Examiner*—Gary L. Welch
*Attorney, Agent, or Firm*—Oblon, Spivak, McClelland, Maier & Neustadt, P.C.

[57] ABSTRACT

A textile machine, more particularly a drawing frame, carries out two drawing passes while reducing as much as possible the harmful effects of any stoppage and eliminating the need for spare tubs holding processed slivers of cotton fibers.

6 Claims, 2 Drawing Sheets

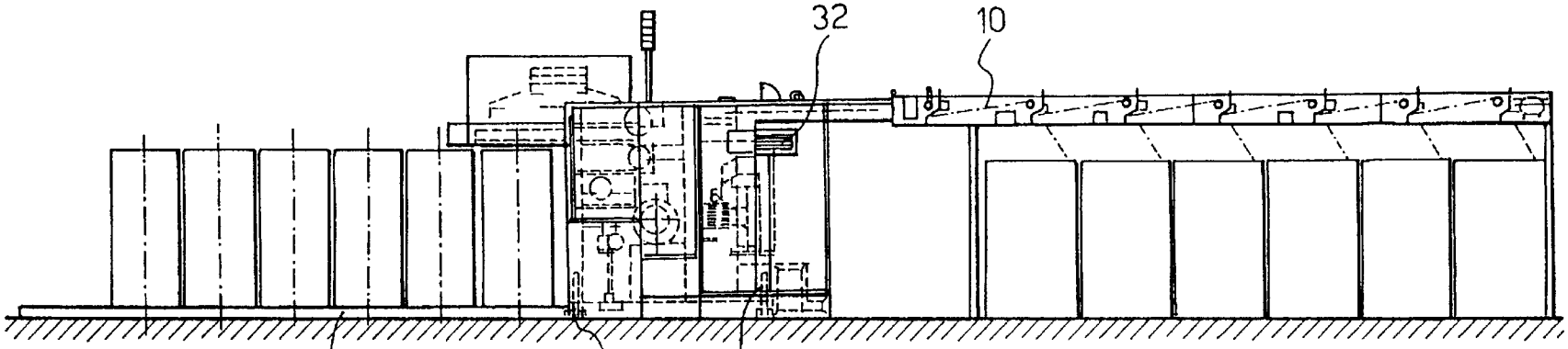
FIG.2
FIG.3
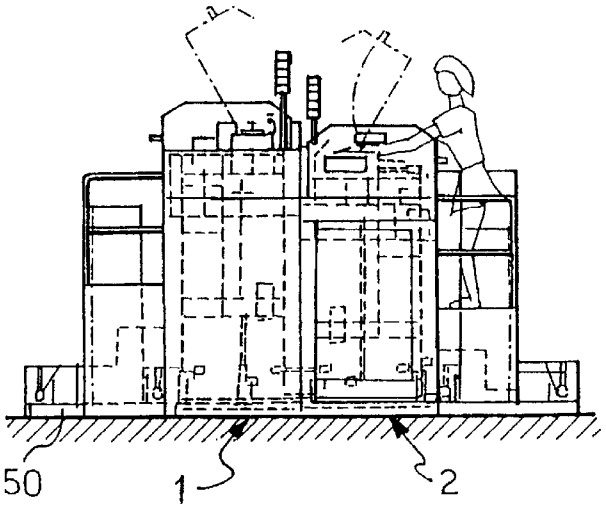

DRAWING FRAME WITH TWO DRAWING HEADS IN CASCADE

BACKGROUND OF THE INVENTION

1. Field of the Invention

The present invention relates to textile machines and, more particularly, to a drawing frame.

2. Description of the Related Art

The method for the processing and spinning of cotton provides for beating and carding of the raw material to produce a sliver of cotton fibers which are to be subjected to drawing.

During the drawing operation, several slivers are joined together to produce a composite sliver having a predetermined count, that is, weight per unit of length, and the fibers of the composite sliver are made parallel to one another by the actual drawing process. This operation may require several successive passes by a single drawing frame or by several drawing frames in cascade until a sliver having the desired count and quality is obtained. With currently available machines and techniques, the slivers are joined together in numbers which may vary from four to eight and, typically, two passes take place by two drawing frames in cascade.

The sliver to be processed, which comes from the carding machines, is supplied to the input of the first drawing frame for the first drawing pass in containers or tubs of dimensions suitable for the structure of the supply members of the drawing frame. The number of tubs to be provided in the input station of the first drawing frame depends on the number of slivers to be joined together.

The sliver output from the first drawing frame is loaded into containers or tubs which are normally smaller than those coming from the cards and which are brought to the second drawing frame for the second drawing pass. The number of tubs to be provided in the input station of the second drawing frame is usually greater than the number of tubs at the input to the first drawing frame. The sliver output from the second drawing frame is loaded into containers or tubs smaller than those coming from the first drawing pass and having dimensions suitable for the structure of the supply members of the machines disposed downstream which, typically, are spinning machines for the subsequent processing of the drawn sliver.

The use of smaller tubs at the output of the second drawing frame than at the input to the first drawing frame is due to the need to supply continuously a number of processing units downstream of the drawing frame which is much larger than the number of carding units.

It is clear from the foregoing that the drawing operation is very critical with regard to the continuity of the production of a spinning plant. In fact, any stoppage of one of the drawing frames, that is, of a single machine, owing to a breakdown or for maintenance not only causes the material coming from the cards to accumulate upstream but also leads to the stoppage of all of the many machines disposed downstream owing to a lack of material to process. In order to minimize the harmful effects of such an event, spare tubs full of processed slivers are normally used at the outputs of both the first and the second drawing frames, with obvious logistical problems owing to the space occupied by the spare tubs and to their handling.

SUMMARY OF THE INVENTION

The main object of the present invention is to propose a machine which can carry out the two drawing passes described above while reducing as much as possible the harmful effects of any stoppage and eliminating the need for spare tubs.

This object is achieved by the provision of the drawing frame defined by the present invention.

BRIEF DESCRIPTION OF THE DRAWINGS

The invention will be understood further from the following detailed description of a preferred embodiment thereof, given by way of a nonlimiting example, with reference to the appended drawings, in which FIGS. 1, 2 and 3 are schematic plan, front elevational and side elevational views, respectively, of a drawing frame according to the invention.

DETAILED DESCRIPTION OF THE INVENTION

Figure 1:
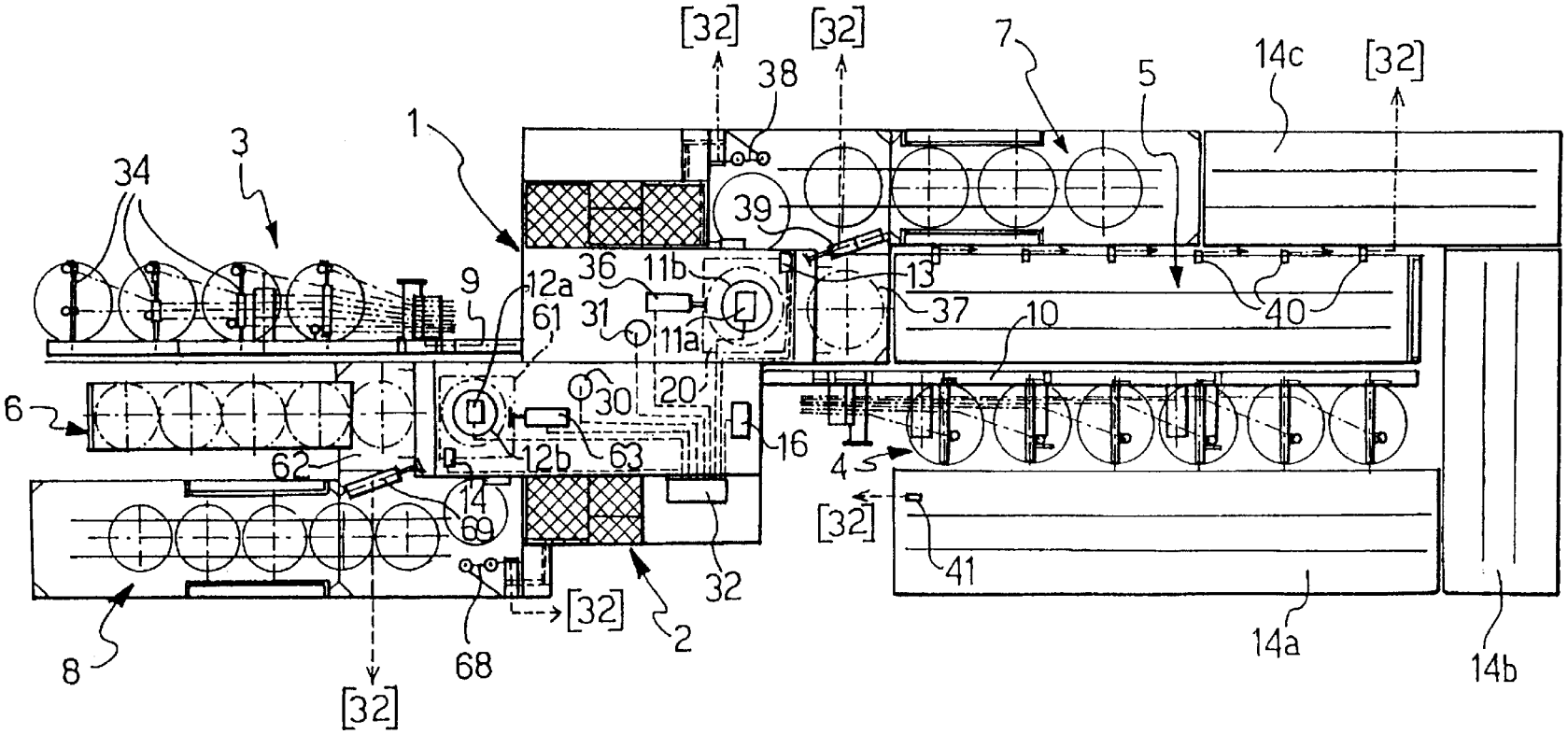

As can be seen in FIG. 3, the drawing frame according to the invention comprises two drawing units or heads, 1 and 2 mounted side by side on a common frame having a base 50 and various associated devices. The two drawing heads have independent drive members, for example, two electric motors with respective transmission systems for driving the drawing rollers of the two drawing units, but have a common control unit. Two motors 30 and 31, functionally connected to a control unit 32, are shown schematically in FIG. 1.

The sliver of cotton coming from the beating and carding machines is brought to an input station 3 of the first drawing head 1 in suitable containers or tubs. The number of tubs depends on the number of slivers to be combined by the drawing in the first head and is therefore determined by the count, that is, by the weight per unit of length, of the sliver to be produced at the output from the first drawing pass. Usually, there are six or eight tubs.

In this embodiment, for simplicity of illustration, there are only four tubs. They are arranged in alignment under sliver-guide devices 34 of a creel 9 which has the usual devices for supplying the sliver to the drawing frame. In this embodiment, two slivers are taken from each tub and are supplied to the drawing head 1 together with those coming from the other tubs in order to be combined into a single sliver and drawn in a known manner. The drawing head 1 in this embodiment is not regulated automatically but the count of the sliver output is monitored by the control unit 32 by a device for measuring the thickness of the sliver, represented by a rectangle 11*a* situated at the output of the set of drawing rollers and connected to the control unit 32 and, if the thickness should deviate from limits predetermined by the user, the machine is stopped and a corresponding warning signal is given.

The sliver processed by the first drawing head 1 is deposited, by a suitable output device 11*b*, in a tub which is in a predetermined loading position 20 of a output station 5 associated with the head 1. A tachometric sensor 13, connected to the control unit 32, measures the length of the sliver produced and provides the control unit 32 with a corresponding datum relating to the quantity of the product deposited in the tub and hence an indication of the level to which the tub is filled. When this level reaches a predetermined limit, the control program of the control unit 32 causes a signal to be generated to activate feed members, for example, a hydraulic cylinder 36, which is connected to the control unit 32 and which moves the full tub from the loading position 20 to an adjacent transit position 37 in the output station 5 associated with the first drawing head 1. At the same time, operating members which are associated with a empty-tub supply station 7 and are represented schematically by a movable arm 38 and by a hydraulic cylinder 39, are activated in order to bring an empty tub already provided in this station to the loading position.

Sensors 40 disposed along the station 5 detect the presence of tubs in the output station 5 and send corresponding signals to the control unit 32. Upon detection of a predetermined number of tubs which are full or filled up to respective predetermined levels, in this case, seven tubs of which one is in the transit position 37, six of these are moved from the output station 5 to the input station 4 of the second drawing head 2. This movement can be carried out manually during the filling of the tub which is in the loading position 20 but may also be carried out automatically under the control of the unit 32. In this case, suitable transfer means and suitable instructions for the control program will be provided.

Six tubs are thus disposed in alignment under the sliver-guide devices of a second creel 10 similar to that of the first head. A sliver is taken from each tub and is supplied to the drawing head 2 together with those coming from the other tubs. The slivers are then combined into a single sliver which is drawn in a known manner.

The second drawing head 2 in this embodiment is regulated automatically by a sensor 16 disposed upstream of the drawing rollers and measuring the thickness of the input slivers combined, and by conventional regulation members connected to the control unit 32 so as to render the count of the sliver output uniform and equal to a predetermined value. In this embodiment, the second drawing head 2 also has a device 12*a* which measures the thickness of the sliver output, and which is connected to the control unit 32 in order to monitor the quality of the sliver output. The processed sliver is deposited by a suitable output device 12*b* in a tub which is in a predetermined loading position 61 of a output station 6 associated with the second head 2. In this case also, a second tachometric sensor 14 measures the length of the sliver produced and supplies the control unit 32 with a datum relating to the quantity of the product deposited in the tub and thus gives an indication of the level to which the tub is filled. When this level reaches a predetermined limit, the control program of the control unit 32 generates a control signal in order to activate feed members, for example, a hydraulic cylinder 63, which moves the full tub from the loading position 61 to an adjacent transit position 62 of the output station 6. At the same time, operating members, for example, a movable arm 68 and a hydraulic cylinder 69 associated with a station 8 for supplying empty tubs, are activated in order to bring an empty tub already provided in this station to the loading position 61. When there is a predetermined number of full tubs in the output station 6, in this embodiment when there are five full tubs, of which one is in the transit position, four of these are picked up, for example, by a trolley in order to be taken to subsequent processing stations.

In order to take account of the various sizes of the input and output tubs, particularly their different heights, each of the structures for supporting the creels 9 and 10 of the two heads 1 and 2 with the respective output calenders and the other sliver-guiding members is supported on four adjustment screws 46 in FIG. 2.

The drawing frame according to FIG. 1 also comprises members for conveying empty tubs from an input station 4 of the second head 2 to the station 7 for supplying empty tubs to the first head 1. These conveyor members 14*a*, 14*b* and 14*c*, which are represented by three guide lines in a U-shaped arrangement, comprise electric, hydraulic or pneumatic actuators which drive suitable kinematic mechanisms with movable arms engaged movably on tracks for engaging corresponding engagement members provided on the bases of the tubs, or conveyor belts or the like, and are not described or shown in detail since they are well known and are within the capability of any expert in mechanical structures. All of these members are controlled and monitored by suitable sensors of the control unit 32. In particular, there is a sensor 41 which detects the presence of tubs on the conveying member 14*a* and generates corresponding signals for the control unit 32.

According to the invention, the control unit comprises a control program which causes control signals to be generated by the control unit 32 in order to control the operating speeds and/or times of the two drawing units in a manner such that, during operation at normal speed, when there is a predetermined number of containers full up to a predetermined level in the output station 5 of the first drawing unit 1, there is an equal number of empty containers in the input station 4 of the second drawing unit, and in order to set the conveyor members 14*a*, 14*b*, 14*c* in operation when the sensor 41 detects at least one empty container in the starting position, that is, in the member 14*a* adjacent the input station 4 of the second unit 2.

There is thus never an excess of processed sliver output from one or the other drawing head and spare tubs are not required. In particular, the number of tubs which collect the sliver processed by the first head 1 and supply it to the second head 2 remains constant.

Moreover, the mounting of the two drawing heads on the same frame and in opposed positions, as shown, affords considerable advantages both with regard to the space occupied and with regard to servicing operations. In fact, the space occupied is clearly less than that of two separate drawing frames and neither trolleys for transporting tubs from one drawing frame to the other nor spare tubs are required. This advantage is achieved without forgoing the capability to operate the two drawing heads independently of one another if the need should arise, since each head has independent drive members and the control program can easily be adapted to widely varying requirements.

It should be noted that the expressions "empty tub" and "full tub" should not be taken literally in either case. Rather, "empty tub" is intended to mean a bin which is not necessarily completely empty but which is to be filled, and "full tub" is a tub which is filled up to a predetermined level. In practice, some of the tubs to be brought to the input station 4 of the second drawing head 2 for the second drawing step may be full up to the brim and some may be half full. In this case, the replacement of the empty tubs with the full tubs can be carried out at two times since, naturally, the tubs which are only half full are emptied before the others.

What is claimed is:

1. A drawing frame comprising:

a first drawing unit (1) and a second drawing unit (2) in cascade, with respective drive members, for each of these units, an input station (3, 4) and an output station (5, 6) which can house containers for sliver to be processed and for processed sliver, respectively, as well as a station (7, 8) for supplying empty containers, supply means (9, 10) associated with each of the input stations (3, 4) for supplying sliver to the respective drawing unit (1, 2), drawing it simultaneously from a respective predetermined number of sliver containers which are in the respective input stations (3, 4), output means (11*b*, 12*b*) associated with each of the output stations (5, 6) for receiving processed sliver from the respective drawing unit (1, 2) and depositing it in a sliver container which is in a loading position (20, 61) of the respective output station (5, 6), control means (32) for regulating and monitoring the operation of the two drawing units, characterized in that the first and second drawing units (1, 2) are mounted on a common frame, and in that it comprises:

measurement means (13, 14) associated with each of the output stations (5, 6) for generating a signal when a container in the loading position (20, 61) is full, first sensor means (40) associated with the output station (5) of the first drawing unit (1) for generating signals indicating the presence of sliver containers in the output station (5), feed means (36) for moving a container from the loading position (20) of the output station (5) of the first drawing unit (1) to another position in the output station in response to a control signal emitted by the control means (32), conveyor means (14*a*, 14*b*, 14*c*) for moving empty containers loaded thereon and coming from the input station (4) of the second drawing unit (2) to the empty-container supply station (7) of the first drawing unit (1) in response to a control signal emitted by the control means (32), second sensor means (41) associated with the conveyor means (14*a*, 14*b*, 14*c*) for generating signals for detecting the presence of sliver containers in a predetermined starting position thereof, and in that the control means (32) comprise a common control unit (32) which is connected to the measurement means (13, 14) and to the first and second sensor means in order to receive signals emitted thereby, as well as to the drive members of the first and second drawing units (1, 2), to the feed means, and to the conveyor means (14*a*, 14*b*, 14*c*) in order to supply control signals thereto, and comprises a control program which controls at least one of the operating speed and times of the two units in a manner such that, during operation at normal speed, when there is a predetermined number of full containers in the output station (5) of the first drawing unit (1), there is an equal number of empty containers in the input station (4) of the second drawing unit (2), and which sets the conveyor means (14*a*, 14*b*, 14*c*) in operation when there is at least one empty container in the starting position (14*a*).

2. A drawing frame according to claim 1, comprising first means for transferring full containers from the output station (5) of the first drawing unit (1) to the input station (4) of the second drawing unit (2) and in which the control program sets the first transfer means in operation when the predetermined number of full containers is in the output station (5) of the first drawing unit (1).

3. A drawing frame according to claim 1 or 2, comprising second means for transferring empty containers from the input station (4) of the second drawing unit (2) to the starting position (14*a*) of the conveyor means (14*a*, 14*b*, 14*c*), and in which the control program sets the second transfer means in operation when the said predetermined number of empty containers is in the input station (4) of the second drawing unit (2).

4. A drawing frame according to claim 1 or 2, in which the drive members comprise two independent electric motors with respective transmission systems for driving the drawing rollers of the two drawing units (1, 2).

5. A drawing frame according to claim 1 or 2, in which at least one of the two drawing units (1, 2) has means (16) for measuring the thickness of the slivers input for the automatic regulation of the thickness of the sliver output.

6. A drawing frame according to claim 1 or 2, comprising a device (11*a*) for measuring the thickness of the sliver output by the set of drawing rollers of at least one of the two drawing units connected to the control unit (32).

* * * * *